United States Patent [19]

Koert et al.

[11] Patent Number: 5,068,669

[45] Date of Patent: Nov. 26, 1991

[54] POWER BEAMING SYSTEM

[75] Inventors: Peter Koert, Washington, D.C.; James T. Cha, Fairfax, Va.

[73] Assignee: APTI, Inc., Washington, D.C.

[21] Appl. No.: 239,284

[22] Filed: Sep. 1, 1988

[51] Int. Cl.[5] ..... H01Q 1/380; H01Q 13/080; H01Q 1/280

[52] U.S. Cl. ..... 343/700 MS; 343/DIG. 2

[58] Field of Search ..... 343/700 MS, 705, 708, 343/846, DIG. 2; 307/151; 361/395

[56] References Cited

U.S. PATENT DOCUMENTS

| | | | |
|---|---|---|---|
| 3,434,678 | 3/1969 | Brown et al. | 244/1 |
| 3,542,316 | 11/1970 | Hart | 244/17.11 |
| 3,989,994 | 11/1976 | Brown | 343/771 |
| 4,079,268 | 3/1978 | Fletcher et al. | 343/700 MS |
| 4,360,741 | 11/1982 | Fitzsimmons et al. | 307/151 |
| 4,697,761 | 10/1987 | Long | 244/62 |
| 4,837,576 | 6/1989 | Schwarz | 342/77 |

OTHER PUBLICATIONS

Brown, W. C., Update on the Solar Power Satellite Xmitter Design, Space Power, vol. 6, pp. 123–135, 1986.

Buechler et al., Silicon High Resistivity-Substrate Millimeter Wave Technology, IEEE Transactions on Microwave Theory and Technologies, vol. MTT-34, No. 12, Dec. 1986.

"Synchotron Radiation Conversion by Rectennas for ARIS-II", by John Santarius, dated Aug. 22, 1989.

"Millimeter-Wave/Infrared Rectenna Development at Georgia Tech", by Mark A. Gouker, Power Beaming Workshop, Apr. 1988.

William C. Brown, "Rectenna Technology Program: Ultra Light 2.45 GHz Rectenna and 20 GHz Rectenna", Raytheon Company, NASA Report No. CR179558, Mar. 11, 1987.

"The History of Power Transmission by Radio Waves", William C. Brown, IEEE Transactions on Microwave Theory and Techniques, vol. MTT-32, No. 9, Sep. 1984.

"A Microwave Powered High Altitude Platform", Schlesak et al., IEEE MTT-S Digest, pp. 283–286, 1988.

"Introduction to Gyro Devices", Varian, Publication No. 4762 11/84.

"Very High Power mm-Wave Components in Oversized Waveguides", by Thumm et al., Microwave Journal, Nov. 1986.

*Primary Examiner*—Rolf Hille
*Assistant Examiner*—Peter Toby Brown
*Attorney, Agent, or Firm*—Foley & Lardner

[57] ABSTRACT

A system and method for power beaming energy from a source at high frequencies and rectifying such energy to provide a source of DC energy is disclosed. The system operates at a frequency of at least 10 GHz and incorporates a rectenna array having a plurality of rectenna structures that utilize circuit elements formed with microstrip circuit techniques.

15 Claims, 6 Drawing Sheets

POWER BEAMING SYSTEM

BACKGROUND OF THE INVENTION

The present invention relates in general to the transfer of energy by means of electromagnetic waves to power a remote device. More specifically, the present invention relates to a system for "power beaming" energy from a source at high frequencies and rectifying such energy to provide a source of DC energy to a remote device.

Attempts have been made for many years to develop a system for beaming energy from a source to power a remote device with a high degree of efficiency (for a general discussion see "The History of Power Transmission by Radio Waves" by William C. Brown, IEEE Transactions on Microwave Theory and Techniques, Vol. MTT-32, No. 9, September 1984). In particular, the concept of powering a satellite or free flying aircraft by power beaming has received a great deal of attention. The advantages of such a system are readily apparent, for example, an aircraft could be maintained on station indefinitely to act as a low cost communications or reconnaissance platform. Early concepts included the conversion of microwave energy into thermal energy to power a helicopter type platform as illustrated in U.S. Pat. 4,542,316 issued to Hart. A more practical approach, however, has focused on converting the microwave energy into DC energy to directly power the platform.

The practical conversion of microwave energy to DC energy for power beaming purposes has been based on the use of rectennas to receive and rectify the microwave energy. Generally, rectennas are limited in their power-handling capabilities, but can be a highly efficient means of converting microwave energy into DC energy for power beaming purposes when employed in large numbers in an array structure. U.S. Pat. 3,434,678 issued to Brown et al. illustrates the use of a rectenna array to power a helicopter platform by power beaming.

More recently, a scale model of a long endurance high altitude platform powered by microwave energy known as SHARP (Stationary High Altitude Relay Platform) has been successfully demonstrated. See "A Microwave Powered High Altitude Platform" by Schlesak et al., 1988 IEEE MTT-S Digest, pp. 283–286. The SHARP concept calls for an array of ground antennas which must be focused on the aircraft. The underside of the aircraft would be coated with a thin-film array of thousands of half-wave dipole rectennas to convert the received microwave energy into DC energy which would be used to power the aircraft's electrical motor. The scale model of the SHARP aircraft was powered by a microwave beam formed from the outputs of two 5 kW continuous-wave magnetrons, which were combined and supplied to a 4.5 meter diameter parabolic antenna to transmit 10 kilowatts of energy at a frequency of 2.45 GHz. Dual polarization rectennas formed of two orthogonal linearly-polarized rectenna arrays were provided on the model aircraft to convert the microwave energy to DC power.

Efforts at power beaming to date, like SHARP discussed above, have focused primarily on using S-band transmission sources due to their ready availability and to reduce power losses due to atmospheric attenuation. S-band power beaming, however, is limited in the amount of power that can be delivered in a practical system. In order to generate sufficient power densities, a large array of ground antennas must be employed which complicates the problem of concentrating the transmitted energy on the aircraft. One could reduce the number of ground antennas employed in the array, but the size of the antennas would increase significantly making them as difficult to track as the array while greatly increasing their expense. In addition, S-band power beaming requires a large amount of surface area for the rectenna array on the aircraft to generate significant power quantities. For example, the SHARP system discussed above would need an array of 100 $m^2$ of rectenna surface to generate only 35 kW of DC power, 25 kW of which is required to power the propulsion system, while requiring a transmitter having a diameter of 85 meters with an output of 500 kw.

SUMMARY OF THE INVENTION

The present invention departs from the prior art by providing a power beaming system that operates at a much higher frequency, on the order of tens of GHz, to thereby provide a system having a power density an order in magnitude greater than conventional power beaming systems while at the same time having the advantage of a smaller transmission source and rectenna array.

More specifically, the present invention provides a power beaming system including a power transmission source capable of generating electromagnetic radiation having a frequency of at least 10 Gigahertz, a transmission antenna mounted on a movable pedestal, a guide unit that guides the electromagnetic radiation generated by the power transmission source to the transmission antenna, a rectenna array located at a position remote from the antenna structure, wherein the rectenna array includes a plurality of multi-layer rectenna structures. Each multi-layer rectenna structure includes a first substrate layer having at least one receiving antenna provided thereon, a ground plane layer and a second substrate layer having circuit elements provided thereon.

BRIEF DESCRIPTION OF THE DRAWINGS

A preferred exemplary embodiment will hereinafter be described in conjunction with the appended drawings wherein like designations denote like elements, and wherein.

DETAILED DESCRIPTION OF THE PREFERRED EMBODIMENTS

Figure 1:
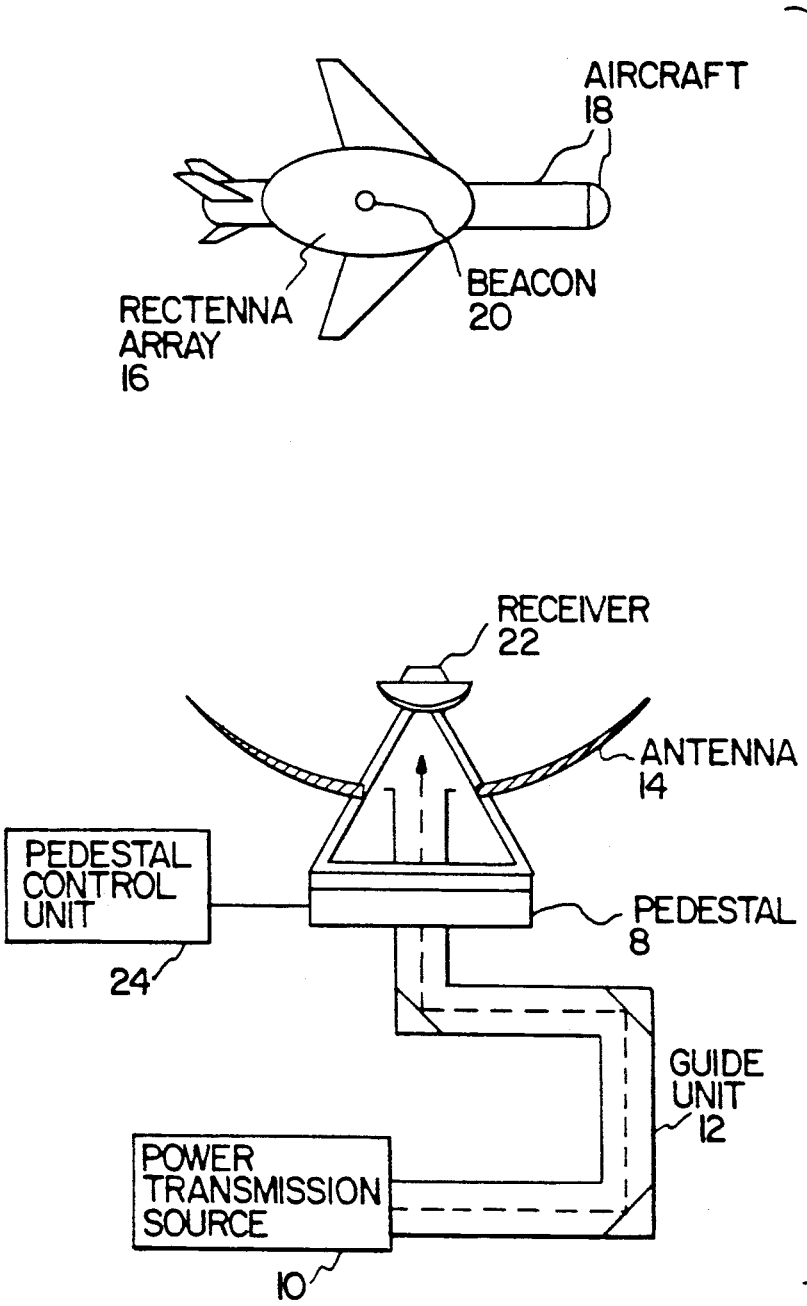
FIG. 1 is an overall system diagram of a power beaming system according to the present invention.

Referring now to FIG. 1, a power beaming system according to the present invention is illustrated having a power transmission source 10 operating at a frequency of at least 10 GHz, and more preferably at least 18 GhZ, that feeds energy to an antenna 14 via a guide unit 12. The antenna 14 is mounted to a movable precision pedestal 8 that is controlled by a pedestal control unit 24. The energy generated by the power transmission source 10 is focused into a beam by the antenna 14 to illuminate a preferable circular rectenna array 16 affixed to the bottom of an electrically powered aircraft 18. The rectenna array 16 converts the energy received from the antenna 14 to DC energy which is used to directly drive the electrical motor of the aircraft 18. The aircraft 18 in a preferred embodiment operates at an altitude of 21 kilometers.

In order to aid in tracking the antenna 14 to the movements of the aircraft 18, a directional beacon 20 is fixed to the center of the rectenna array 16. The directional beacon 20, preferably operating in the X-band frequency range, emits a tracking signal that is received by a receiver 22 located on the antenna 14. The output signal from the receiver 22 is used by a pedestal control unit 24 to control the tracking movements of the antenna 14 and insure that the energy beam generated by the system is centered on the rectenna array 16.

Figure 2:
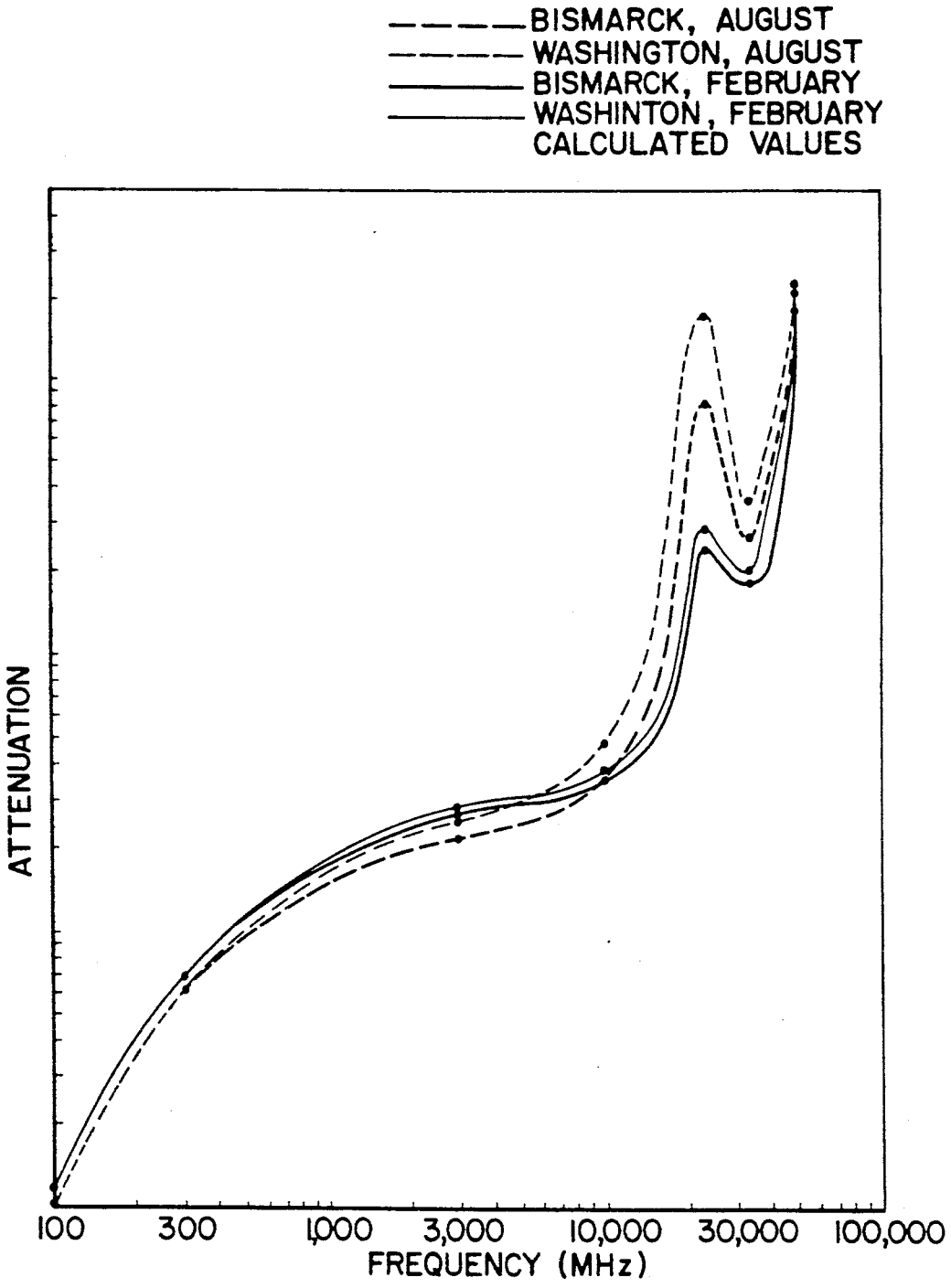
FIG. 2 is a graph illustrating atmospheric attenuation of electromagnetic waves at various frequencies.

As previously mentioned, one of the reasons conventional systems have been limited to S-band power beaming is to reduce power losses due to atmospheric attenuation of the transmitted beam. Generally, attenuation increases as operating frequency increases as illustrated by the chart shown in FIG. 2 (see "Radar Handbook" by M.I. Skolnik, McGraw-Hill Book Company, N.Y. 1970, p. 24–26). At around 35 GHz., however, atmospheric attenuation drops off. Thus, a power beaming system operating in the range of about 28–44 GHz and preferably around 35 GHz, provides the advantages associated with operating at higher transmission frequencies, such as the reduction in size of the ground antenna and the rectenna array while operating at higher power densities, with approximately the same amount of attenuation experienced at lower frequencies.

In order to generate sufficient power densities at the desired frequency, one or more gyrotrons are preferably used for the power transmission source 10. The term "gyrotron" will be used throughout this specification to generically describe microwave oscillators based on the interaction of electrons orbiting in a DC magnetic field under the conditions of cyclotron resonance where the magnitude of the DC magnetic field and the microwave frequency are specifically related. Typically gyrotrons include single-cavity oscillators wherein the entire interaction takes place in a single microwave cavity, but it will be understood that the same basic interaction can be used with varying devices, such as amplifiers using several resonant cavities, which may sometimes be referred to as gyroklystrons, gyro TWTs or even cyclotron resonance masers, and that the term gyrotron is intended to cover all such devices. A more detailed explanation of gyrotrons is provided in the paper "Introduction to Gyro Devices", VARIAN publication number 4762 11/84, incorporated herein by reference. Gyrotrons producing power outputs between 200–300 kW at frequencies of 28 Ghz to 60 GHz are presently in use, and the outputs of one or more gyrotrons can be combined to obtain desired power output levels for the power transmission source 10.

Gyrotrons generally produce $TE_{On}$ modes which produce a hollow conical radiation pattern with zero power along the waveguide axis. When using a gyrotron for the power transmission source 10, however, it is desirable to perform a mode conversion operation in order to generate a narrow beam with a well-defined polarization. Accordingly, the guide unit 12 is constructed to perform the desired mode conversion. Mode converter assemblies for use in the guide unit 12 may be constructed out of waveguide assemblies as illustrated in the paper entitled, "Very High Power mm-Wave Components in Oversized Waveguides" by Thumm et al., Microwave Journal, November 1986 incorporated herein by reference, to produce a beam having the desired characteristics. Alternatively, beam waveguides could be employed for the guide unit 12 as described in the article entitled "Some Aspects of Beam Waveguide Design" by Chan et al., IEEE Proceedings, Vol. 129 Pt H No. 4, August 1982, incorporated herein by reference.

Figure 3A:
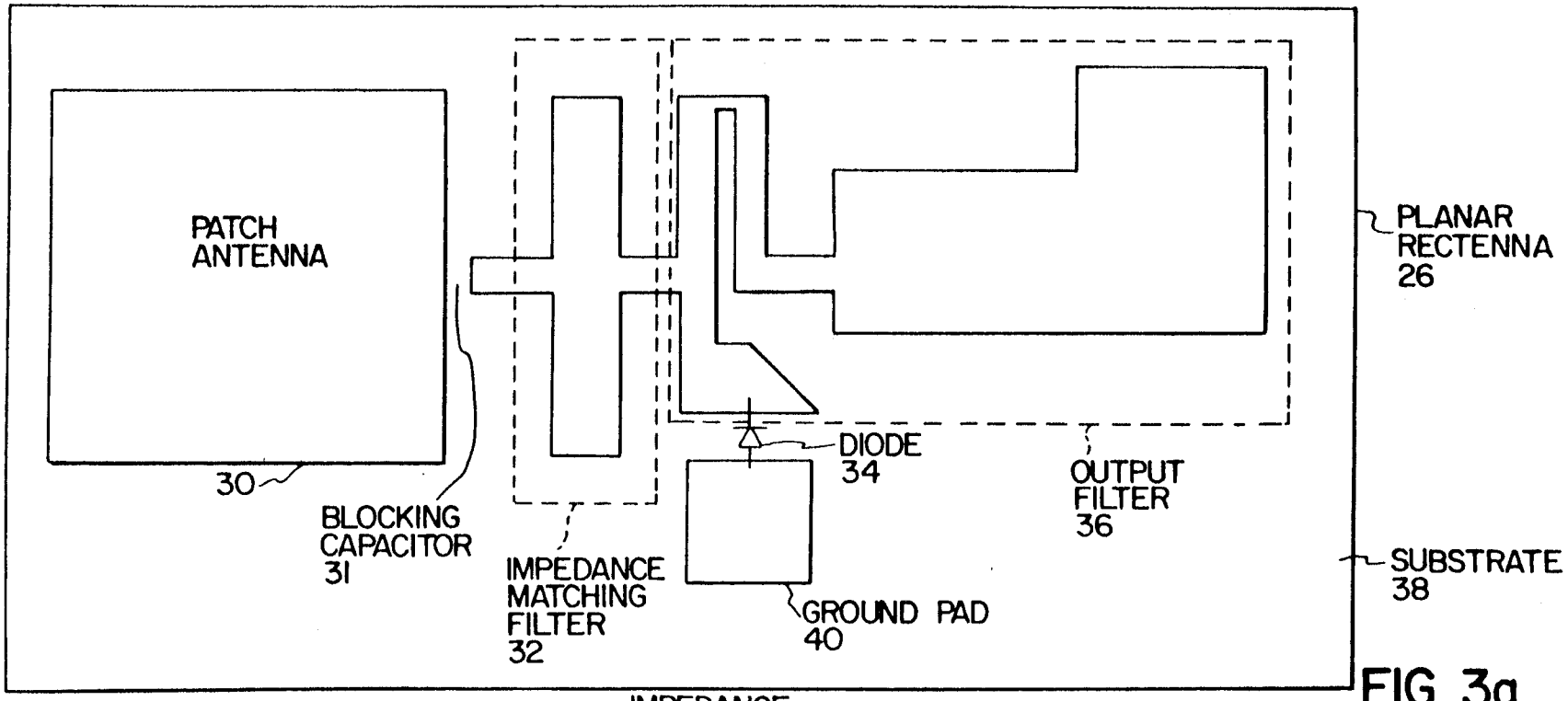
FIG. 3*a* illustrates a planar rectenna structure that may be incorporated in the system illustrated in FIG. 1.

Referring now to FIG. 3*a*, a planar rectenna 26 that may be employed in the rectenna array of the present system is shown having a patch antenna 30 which acts as a ½ wave resonator, an impedance matching filter 32, coupled to the patch antenna 30 by a blocking capacitance 31, for matching the impedance of the patch antenna 30 to a diode 34 (for example, ALPHA DMK6606), and an output filter 36.

The impedance matching filter 32 and output filter 36 of the planar rectenna 26 are formed using microstrip circuitry techniques on a dielectric substrate 38 (for example RT-DUROID manufactured by Rogers Corporation, dielectric constant 2.2) of the planar rectenna 26. Microstrip circuitry provides a simple and economical method of providing the circuit elements of the impedance matching filter 32 and output filter 36 in a compact structure, and permits the diode 34 to be located as close as possible to the patch antenna thereby avoiding losses due to lengthy interconnect lines. For example, the components of the impedance matching circuit 32 and the output filter 36 are formed by conventional copper etching techniques on a top surface of the dielectric substrate 38. A ground pad 40 is also provided to provide electrical connection via plated through holes to a ground plane (not shown) provided beneath the dielectric substrate 38.

The patch antenna 30 provides the advantage of dual polarization in a very simple structure without necessitating the overlapping of two linearly-polarized antenna layers. Other antenna structures may be employed; however, an antenna which is independent of the polarization of the incoming electromagnetic radiation is preferred.

Figure 3B:
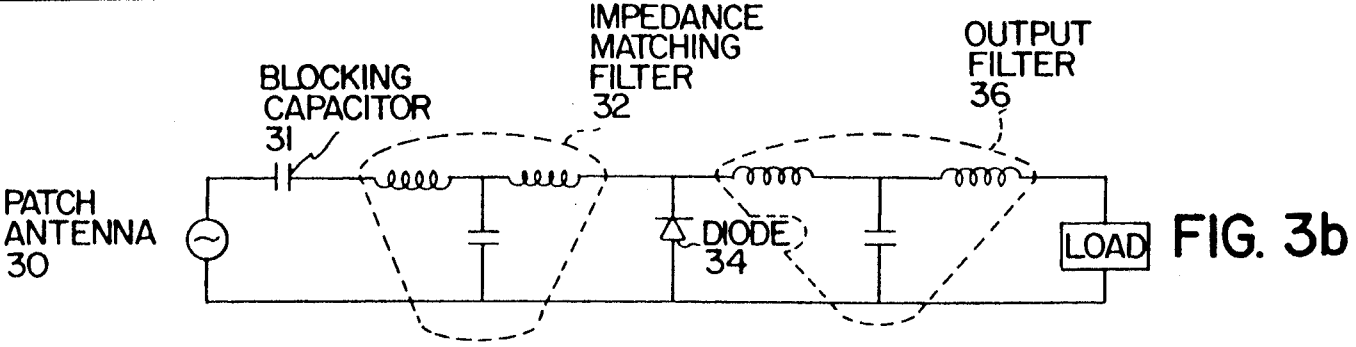
FIG. 3*b* is a circuit diagram of the planar rectenna array shown in FIG. 3*a;*
Figure 4A:
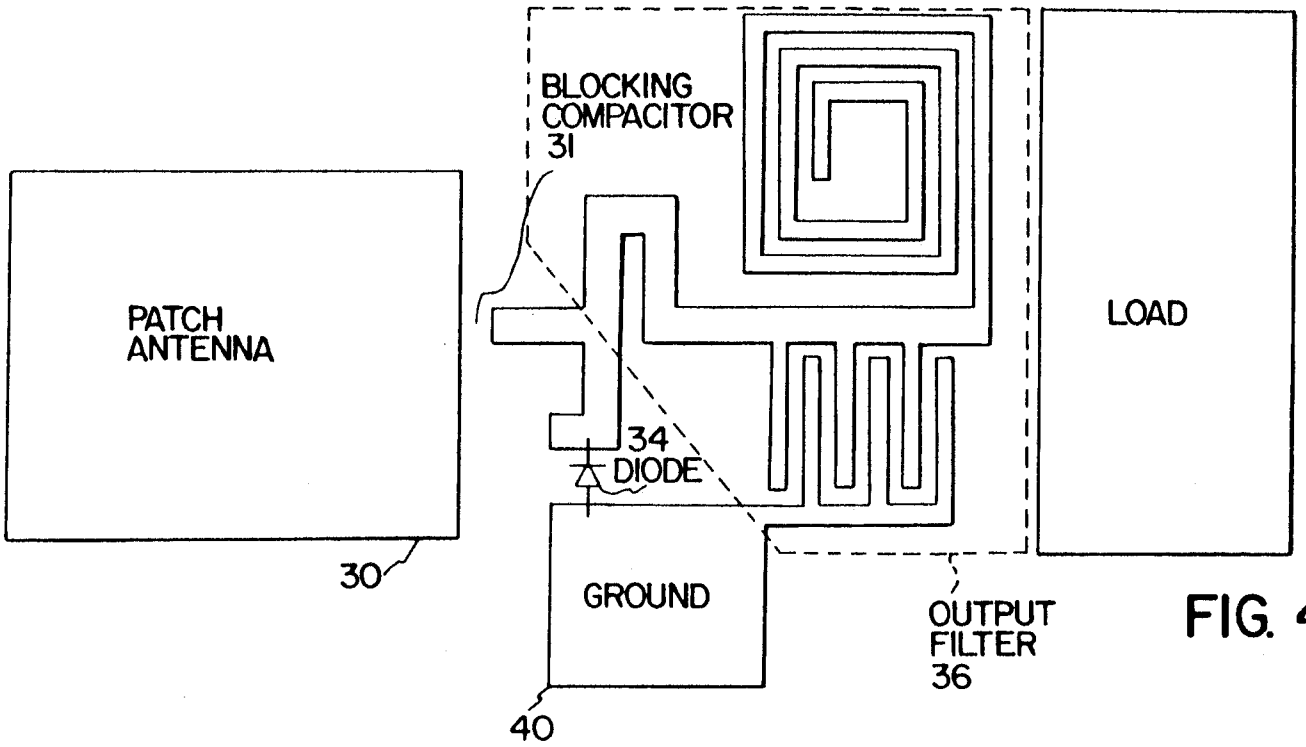
FIG. 4*a* illustrates a second planar rectenna structure that may be incorporated in the system illustrated in FIG. 1.
Figure 4B:
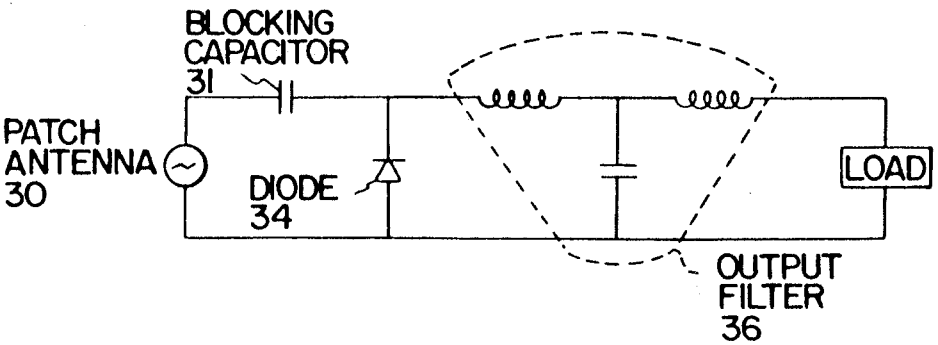
FIG. 4*b* is a circuit diagram of the planar rectenna illustrated in FIG. 4*a;*

A circuit diagram of the planar rectenna 26 is provided in FIG. 3*b*. Configurations and circuit arrangements other than those illustrated in FIG. 3*a* and 3*b* are of course possible. For example, a second planar rectenna structure is illustrated in FIG. 4*a* which does not utilize an impedance matching filter. The circuit diagram for this planar rectenna structure is shown in FIG. 4*b*. The impedance matching filter is desirable, however, to optimize the output of the rectenna.

While the above described rectenna structure has been demonstrated to operate effectively in the frequency range of interest, it has a disadvantage in that the impedance matching and output filters take up a large percentage of the surface area of the substrate which limits the power conversion efficiency of the rectenna array. In other words, the rectenna array provides maximum efficiency when the maximum number of antennas can be provided on the surface area of the array. This problem can be addressed by providing a multi-layer rectenna structure, as opposed to the planar rectenna illustrated in FIG. 3, in which the antenna is located on the surface of the substrate and the circuit elements, i.e., the impedance matching and output filters and the diode, are located in a separate layer beneath the antenna to provide a compact structure.

Figure 5A:
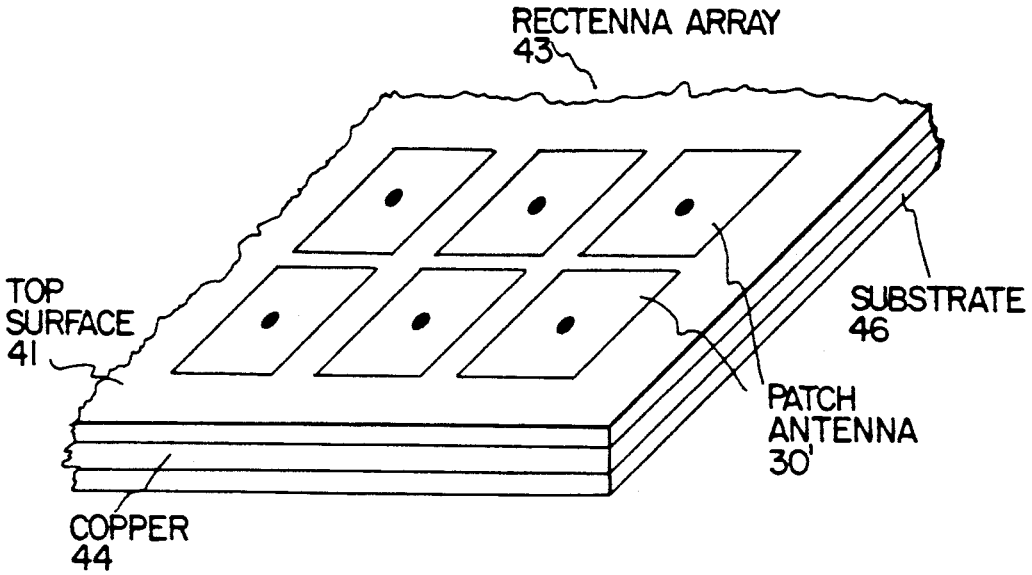
FIGS. 5*a* and 5*b* illustrate top and bottom surfaces, respectively, of a multi-layer rectenna structure that may be incorporated in the system illustrated in FIG. 1.
Figure 5B:
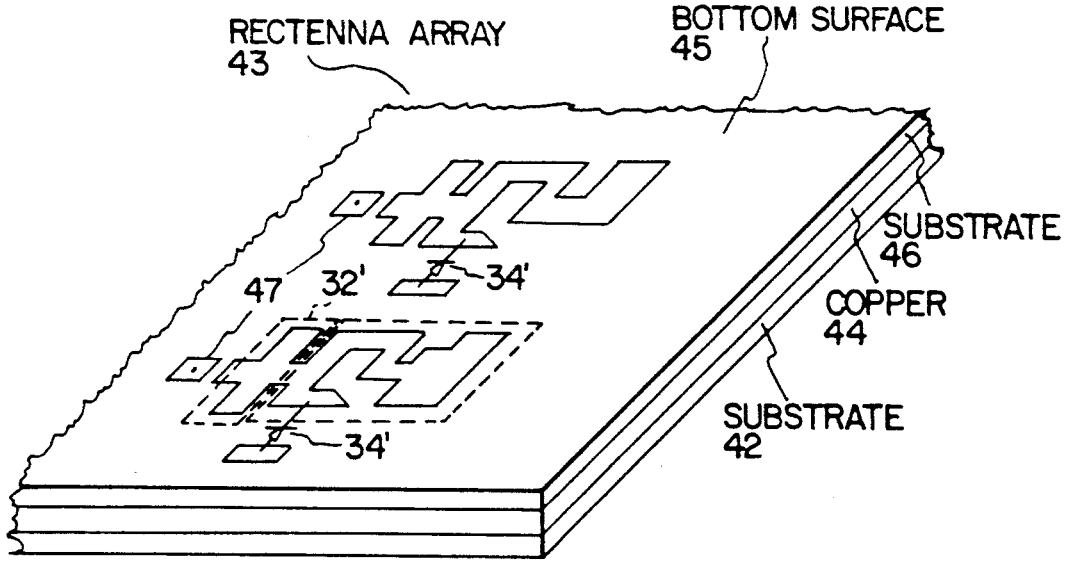

Referring now to FIG. 5*a*, a top surface 41 of a rectenna array 43 incorporating multi-layer rectennas is shown having a first substrate 42 on which a patch antenna 30' of each multi-layer rectenna is provided, a copper ground plane 44, and a second substrate 46 on which the circuit elements, i.e., the impedance matching filter 32', diode 34' and output filter 36', are provided as shown in FIG. 5*b*. The patch antennas 30' are coupled to the impedance matching filter 32' on the bottom surface 45 of the rectenna array 43 via plated-through holes 47. Thus, the patch antennas 30' may be readily spaced in the rectenna array (in this case ½ wavelength center to center) to provide maximum power conversion efficiency while maintaining a rectenna structure that may be easily fabricated using multi-layer circuit board fabrication techniques. It will be readily understood that in an array structure one output filter may be provided for a plurality of rectennas instead of providing each rectenna with its own output filter, and that the circuit elements may be provided on the inside surface of the substrate 46 if an insulating layer is positioned between the circuit elements and the ground plane 44.

Figure 6:
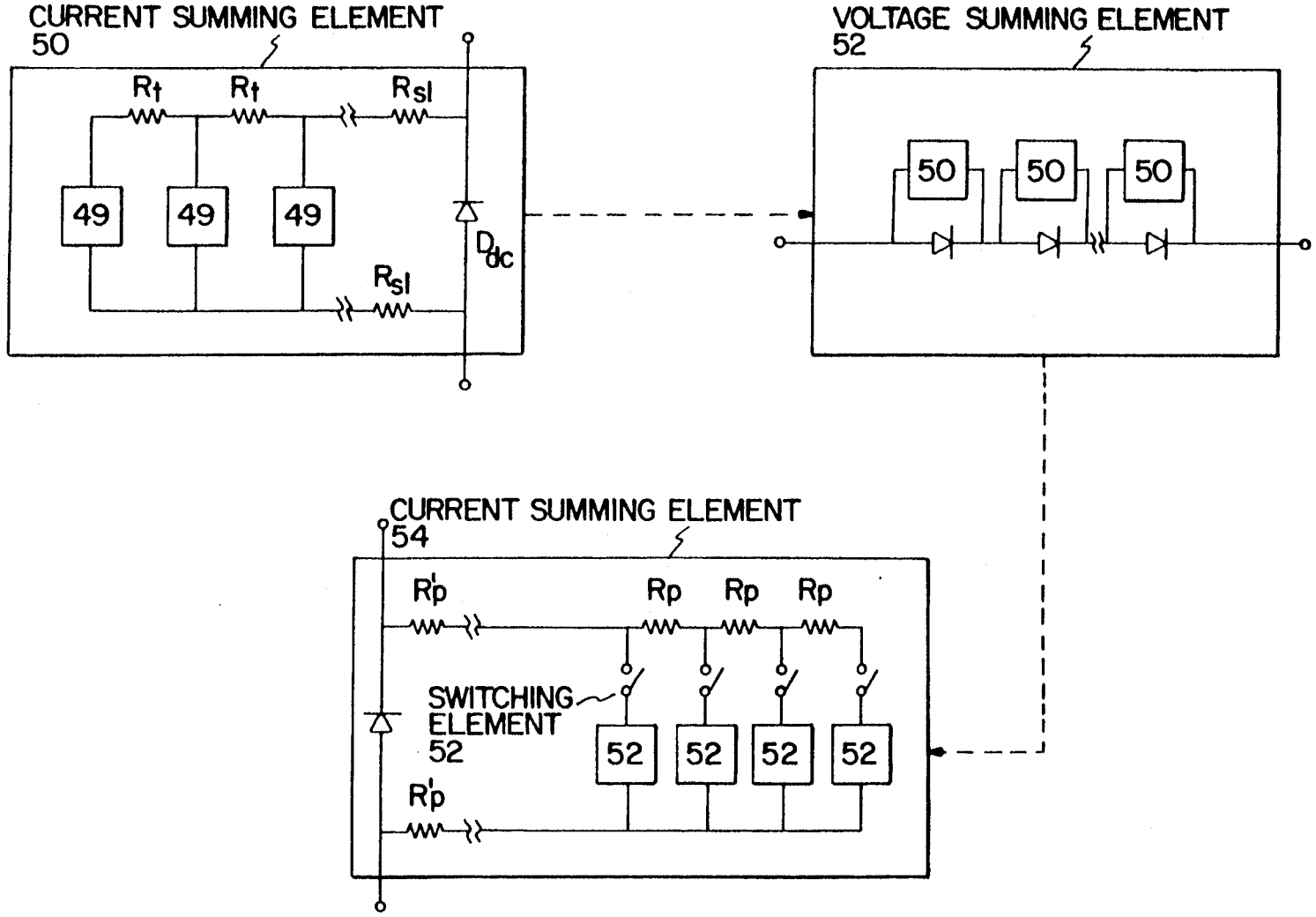
FIGS. 6 illustrates various components of a power combining network.

It is of course necessary to combine the outputs from each of the individual rectennas in the array 43 to provide useful voltage and current levels. FIGS. 6 illustrates a power combining network which can be used to match the voltage and current output of the rectenna array to any desired load. In addition, the power combining network prevents the failure of one or more rectennas from seriously effecting the output of the entire array by providing a plurality of current and voltage summing elements.

As shown in FIG. 6, a current summing element 50 is formed by combining the output of several individual rectennas 49 in parallel. The resistance $R_l$ represents the resistance associated with the interconnect lines between the individual rectennas. Discrete resistors $R_{sl}$, having a value much greater than $R_l$, couple the rectennas to a diode $D_{dc}$. The current summing elements may then be combined in series to form a voltage summing element 52. Individual voltage summing elements 52 can then be combined to form additional current summing elements 54. Switching elements 56 are also provided so that the various current and voltage summing elements can be combined in any desired pattern to match the voltage and current requirements of the load.

It will be readily understood that variations and modifications may be made within the spirit and scope of the invention as expressed in the appended claims, and that the invention is not limited to the specific forms illustrated above. For example, many different circuit configurations for the rectenna structures are possible, along with different combinations of summing elements in the power combining network. In addition, a single output filter may be provided for a plurality of rectenna structures in an array, rather than providing an output filter for each rectenna structure.

What is claimed is:

1. A power beaming system comprising:

a. a power transmission source capable of generating electromagnetic radiation having a frequency of at least 10 Gigahertz;

b. a transmission antenna;

c. a guide unit that guides said electromagnetic radiation generated by said power transmission source to said transmission antenna;

d. a rectenna array located at a position remote from said antenna structure, said rectenna array comprising a plurality of multi-layer rectenna structures, each multi-layer rectenna structure including a first substrate layer having at least one receiving antenna provided thereon, a ground plane layer and a second substrate layer having circuit elements provided thereon, wherein said rectenna array includes a power combining network, said power combining network including a plurality of first current summing elements, each current summing element comprising a plurality of said multi-layer rectenna structures electrically connected in parallel, and at least one voltage summing element comprising a plurality of said first current summing elements electrically connected in series.

2. A power beaming system as set forth in claim 1, further comprising:

i. a movable pedestal supporting said transmission antenna;

ii. a direction beacon that generates a tracking signal indicative of the location of said rectenna array;

iii. a pedestal control unit coupled to said pedestal; and iv. a receiver unit electrically coupled to the pedestal control unit that receives the tracking signal from the direction beacon and provides the tracking signal to the pedestal control unit.

3. A power beaming system as claimed in claim 1, wherein said power transmission source generates said electromagnetic radiation at a frequency of at least 18 GHz.

4. A power beaming system as claimed in claim 1, wherein said power transmission source generates electromagnetic radiation at frequency of about 28–44 GHz.

5. A power beaming system as claimed in claim 1, wherein said power transmission source generates electromagnetic radiation at a frequency of about 35 GHz.

6. A power beaming system as claimed in claim 1, wherein said power transmission source is a gyrotron.

7. A power beaming system as claimed in claim 6, wherein said guide unit provides mode conversion of the electromagnetic radiation generated by said gyrotron.

8. A power beaming system as claimed in claim 7, wherein said guide unit comprises a waveguide assembly.

9. A power beaming system as claimed in claim 8, wherein said guide assembly comprises a beam waveguide.

10. A power beaming system as claimed in claim 1, wherein said receiving antenna of said multilayer rectenna structure receives said electromagnetic radiation independently of its polarization.

11. A power beaming system as claimed in claim 10, wherein said receiving antenna comprises a patch antenna.

12. A power beaming system as claimed in claim 1, wherein said circuit elements comprise an impedance matching circuit, a diode and an output filter.

13. A power beaming system as claimed in claim 1, wherein said power combining network further comprises at least one second current summing element comprising a plurality of said voltage summing elements electrically connected in parallel.

14. A multi-layer rectenna structure comprising:

a. a first substrate having at least one receiving antenna provided thereon;

b. a second substrate having circuit elements provided thereon; and c. a ground plane located between said first and second substrate; and d. wherein said circuit elements comprise an impedance matching filter coupled to said receiving antenna via a coupling capacitance, a diode electrically coupled to said matching filter, and an output filter electrically coupled to said diode.

15. A multi-layer rectenna structure as claimed in claim 14, wherein said impedance matching filter and said output filter are formed using microstrip circuit techniques.

* * * * *